US008139964B2

(12) United States Patent
Hayamizu

(10) Patent No.: US 8,139,964 B2
(45) Date of Patent: Mar. 20, 2012

(54) FIXING DEVICE, CONTROL METHOD FOR A FIXING DEVICE AND IMAGE FORMING APPARATUS

(75) Inventor: Hitoshi Hayamizu, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 67 days.

(21) Appl. No.: 12/843,118

(22) Filed: Jul. 26, 2010

(65) Prior Publication Data

US 2011/0026947 A1 Feb. 3, 2011

(30) Foreign Application Priority Data

Jul. 29, 2009 (JP) ..... 2009-176350
Mar. 29, 2010 (JP) ..... 2010-075301

(51) Int. Cl.
*G03G 15/20* (2006.01)

(52) U.S. Cl. ..... 399/33; 399/9; 399/69

(58) Field of Classification Search ..... 399/9, 33, 399/67, 69, 122, 320
See application file for complete search history.

(56) References Cited

FOREIGN PATENT DOCUMENTS

JP 2006-154649 6/2006

*Primary Examiner* — Mark R Gaworecki
(74) *Attorney, Agent, or Firm* — Smith, Gambrell & Russell, LLP

(57) ABSTRACT

Provided is a fixing device including: a heater; a heating body that is heated by the heater and is caused to rotate; a pressure body that is in contact with the heating body, and is caused to rotate; a plurality of temperature sensor units each including a temperature sensing element that is covered with a protective member and is in contact with the heating body in order to sense a temperature of the heating body; and a control unit that recognizes temperatures of the heating body at respective portions thereof based on signals received from the temperature sensor units, brings the heater into an ON state if the recognized temperatures exhibit a temperature difference of a predetermined value or larger, judges that the protective member has peeled off if all the temperatures sensed by using the temperature sensor units are recognized to have risen, and corrects the temperature.

19 Claims, 9 Drawing Sheets

FIXING DEVICE, CONTROL METHOD FOR A FIXING DEVICE AND IMAGE FORMING APPARATUS

This application is based upon and claims the benefit of priority from the corresponding Japanese Patent Application No. 2009-176350 filed on Jul. 29, 2009, and Japanese Patent Application No. 2010-075301 filed on Mar. 29, 2010, the entire contents of which are incorporated herein by reference.

BACKGROUND OF THE INVENTION

1. Field of the Invention

The present invention relates to a fixing device that fixes a toner image and an image forming apparatus such as a multifunction peripheral, a copier, a printer, or a facsimile machine which includes a fixing device.

2. Description of Related Art

In general, an image forming apparatus such as a printer of an electrophotographic system includes a fixing device that includes a heater, heats/pressurizes a toner image formed on a sheet, and fixes the toner image to the sheet. Then, a member for heating toner, such as a roller, a belt, or a film, is heated by the heater. However, for example, there is a problem that toner is not fully fused if a temperature of the roller or the like is too low and that the toner is excessively fused if the temperature is too high. Therefore, the temperature of the roller or the like needs to be maintained at a temperature suitable for fixation. To maintain the temperature of the roller or the like at the suitable temperature, it is necessary to sense the temperature of the roller or the like. To this end, for example, there is known a fixing device that senses the temperature inside the fixing device.

Specifically, for example, disclosed is a heating device (fixing device) including: a heating body; a pressure member that forms a press-contacting nip portion in contact with the heating body; and at least two temperature sensor elements that sense a temperature of the heating body, in which: after the pressure member is caused to pivot and a heating process is performed for a material to be heated that has been conveyed/introduced into the press-contacting nip portion, the material to be heated is discharged, the heating device is caused to stop; and if the material to be heated having a width shorter than a predetermined size is conveyed, at least one of the temperature sensor elements is located in a position to be a sheet passing portion, at least another one of the temperature sensor elements is located in a position to be a non-sheet passing portion, and a time from the end of the heating process for the material to be heated until the stopping of the driving of the heating device is caused to change according to a difference between temperatures sensed by the temperature sensor element at the non-sheet passing portion and the temperature sensor element at the sheet passing portion. With this structure, for example, needless driving of the heating device after the end of the heating process may be prevented, which elongates the life of the heating device.

As in the above-mentioned heating device, the fixing device may be provided with a plurality of temperature sensor units. In addition, the temperature sensor unit includes a temperature sensing element (for example, thermistor), and performs temperature sensing by bringing the temperature sensing element into contact with an object of sensing such as the roller.

Meanwhile, in a case of a fixing device in which a sheet is conveyed with a center part of an axis direction of a roller or the like aligned with a center of the sheet (hereinafter, referred to as "center sheet passing"), the sheet is occasionally conveyed with the sheet positioned close to one side of the roller or the like due to an uneven pressing force at a nip or other such factor. The one-sided conveyance of the sheet is likely to cause a paper jam of the sheet, and the temperature may keep rising without heat loss particularly at an end portion through which the sheet does not pass, which necessitates replacement of the fixing device. To sense such one-sided conveyance of the sheet, for example, the temperature sensor unit is provided to each of two portions (for example, both end portions) of the roller or the like in its axis direction. Then, during printing, when a difference between the temperatures sensed by using both the temperature sensor units becomes equal to or higher than a fixed value, it is sensed that the one-sided conveyance of the sheet is being performed.

Meanwhile, the object of sensing such as the roller is caused to rotate due to the sheet conveyance or the like. To protect against friction due to rotation or for other such purpose, the temperature sensing element in contact with the roller or the like may be covered with a protective member such as an insulating tape. However, the rotation of the object of sensing such as the roller may cause the protective member to peel off while the image forming apparatus is being used.

Then, the temperature sensing element from which the protective member has peeled off comes into direct contact with the object of sensing such as the roller. In other words, in comparison with the temperature sensing element from which the protective member has not peeled off, a distance from the roller or the like becomes smaller (the distance from the roller or the like becomes almost zero). This may cause a difference between the sensed temperature obtained by using the temperature sensing element from which the protective member has peeled off and the sensed temperature obtained by using the temperature sensing element from which the protective member has not peeled off. Note that the peeling off of the protective member is not so serious an issue that necessitates the replacement of the fixing device and is not so harmful as one-sided sheet conveyance, and hence correction of the sensed temperature suffices.

However, if there is a difference between the temperatures sensed by the temperature sensor units, a problem arises in that it may be erroneously sensed that the one-sided sheet conveyance is being performed even if the difference is ascribable to the peeling off of the protective member. Accordingly, there arises another problem in that it is necessary to judge whether or not the temperature difference is caused by the peeling off of the protective member.

SUMMARY OF THE INVENTION

In view of the above-mentioned problems inherent in the related art, an object of the present invention is to prevent erroneous sensing of a failure or an error by correcting a sensed temperature of a temperature sensor unit from which a protective member has peeled off and to alleviate a load on a user by eliminating unnecessary replacement of a fixing device.

In order to achieve the above-mentioned object, a fixing device according to an aspect of the present invention includes: a heater; a heating body that is heated by heat generated by the heater and is caused to rotate; a pressure body that is in contact with the heating body, forms a nip through which a sheet having a toner image transferred thereonto enters, and is caused to rotate; a plurality of temperature sensor units each including a temperature sensing element that is covered with a protective member and is in contact with the heating body in order to sense a temperature of the heating body; and a control unit that is configured to: recognize temperatures of the heating body at respective portions thereof based on signals received from the plurality of temperature sensor units; judge that a failure has occurred if the temperatures are different from each other by a fixed value or larger; bring the heater into an ON state if the recognized temperatures exhibit a temperature difference of a predetermined value or larger, and then judge that the protective member has peeled off if all the temperatures sensed by using the plurality of temperature sensor units are recognized to have risen; and correct the recognized temperature sensed by using one of the plurality of temperature sensor units that has been determined to have the protective member peeled off.

According to this aspect, if there is the temperature difference equal to or larger than the predetermined value between the recognized temperatures sensed respectively by using the plurality of temperature sensor units, the heater is temporarily brought into an ON state, and the rise in the temperature is checked. Accordingly, it is judged whether or not there is an abnormality such as a wire break and whether or not there is a temperature difference due to the peeling off of the protective member. In addition, the control unit corrects the temperature sensed by the temperature sensor unit from which the protective member has peeled off. This correction eliminates erroneous sensing of a failure, an error, or the like regarding one-sided sheet conveyance because of the fact that the temperatures sensed respectively by using the plurality of temperature sensor units exhibit a temperature difference of a fixed value or larger. This in turn eliminates the need for the replacement of the fixing device only because of the peeling off of the protective member, which alleviates the load on the user in terms of cost.

Note that the fixed value may be defined arbitrarily (for example, tens to several tens of ° C.) in consideration of heat resistance or other such factors of a heating roller, a gear that drives the heating roller, and other such driving mechanism. Further, by using a temperature sensor including a thermistor from which the protective member has peeled off and a temperature sensor including a thermistor from which the protective member has not peeled off, the predetermined value may be defined based on a difference between the temperatures sensed respectively by using those temperature sensors when an object having the same temperature was measured in advance. Note that the heating by the heater may be uneven, and hence the predetermined value is set to a value that exceeds a temperature difference that may be generated when none of protective tapes have peeled off from the temperature sensor units.

Further features and advantages of the present invention become clearer with reference to embodiments described below.

DETAILED DESCRIPTION OF PREFERRED EMBODIMENTS (First embodiment)

Hereinafter, description is made of a first embodiment of the present invention with reference to FIG. 1 to FIG. 7. However, the scope of the present invention is not limited by structures, configurations, layouts, and other such elements indicated by the following embodiment, which are mere examples for the description.

(Outline of an Image Forming Apparatus)

Figure 1:
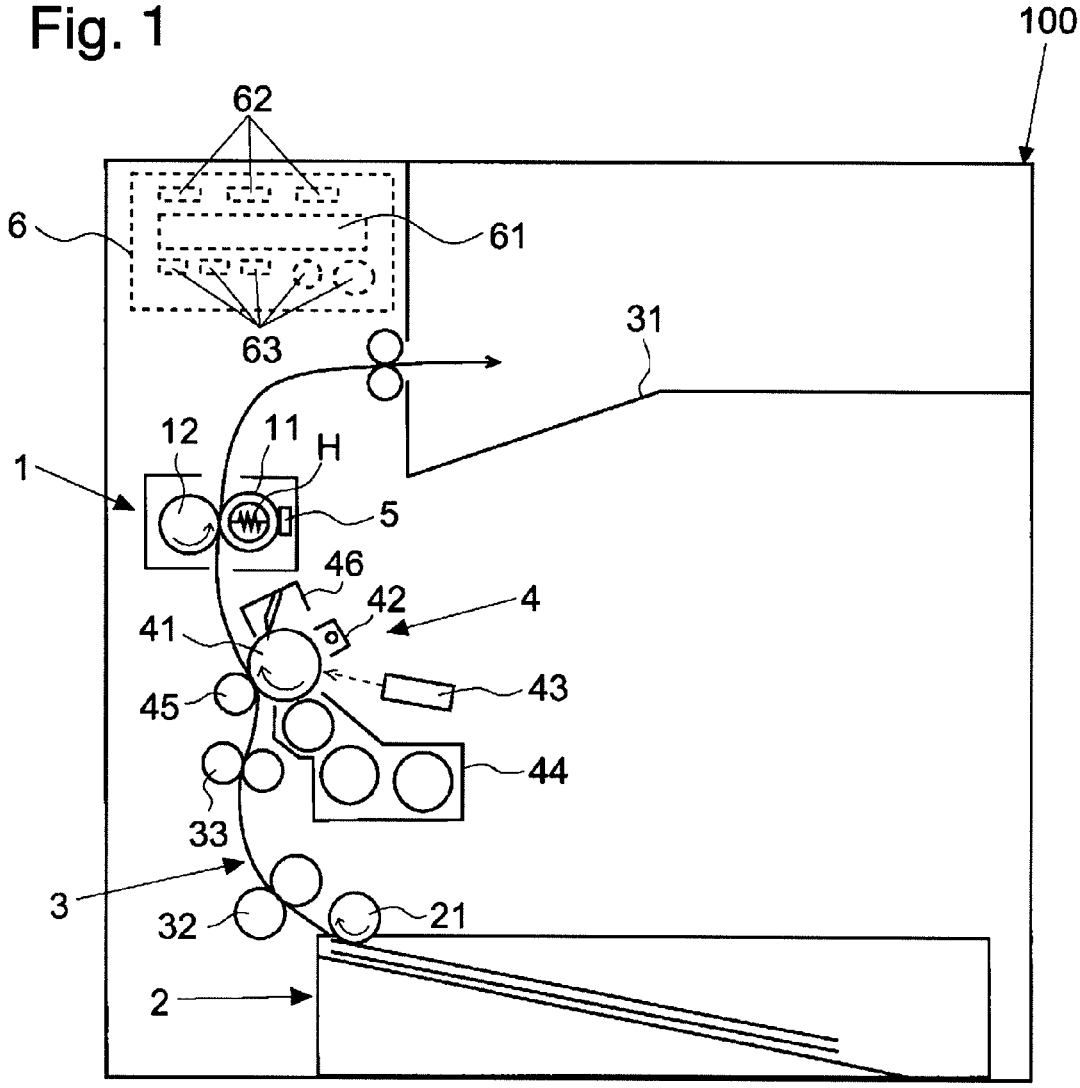
FIG. 1 is a schematic front sectional view illustrating an outline structure of a printer according to a first embodiment of the present invention.

First, with reference to FIG. 1, description is made of an outline of a printer 100 of an electrophotographic system (corresponding to an image forming apparatus) that forms a toner image and causes a fixing device 1 to fix the toner image. FIG. 1 is a schematic front sectional view illustrating an outline structure of the printer 100 according to the first embodiment of the present invention.

As illustrated in FIG. 1, the printer 100 according to the first embodiment includes a sheet feeding unit 2, a conveyance path 3, an image forming unit 4, and the fixing device 1, which are arranged in the stated order from the bottom.

The sheet feeding unit 2 is provided at the lowermost part of the printer 100, and stores sheets such as copy paper of each type and each size (such as A4 or B5). The sheet feeding unit 2 is provided with a sheet feeding roller 21 on a downstream side of the sheet conveyance direction. The sheet located at the uppermost level of a stack of sheets abuts against the sheet feeding roller 21, and in sheet feeding, the sheet feeding roller 21 is driven to rotate by a drive unit such as a motor, to thereby feed the sheets into the conveyance path 3 one by one.

Then, the conveyance path 3 conveys the sheet fed from the sheet feeding unit 2 to a discharge tray 31 via the image forming unit 4. To this end, the conveyance path 3 is provided with a conveyance roller pair 32 driven to rotate by a drive unit such as a motor, a registration roller pair 33 that feeds the sheet into a nip between a transfer roller 45 and a photosensitive drum 41 at a timing determined by the toner image, and the like.

In FIG. 1, the image forming unit 4 is located in a center-left position inside the printer 100. For example, based on image data on a document or the like transmitted from an external computer such as a PC 200 (personal computer; see FIG. 2), the image forming unit 4 forms a toner image corresponding to an image to be formed, and transfers the toner image onto the sheet. The image forming unit 4 includes: the photosensitive drum 41; and a charging device 42, an exposure device 43, a developing device 44, the transfer roller 45, and a cleaning device 46, which surround the photosensitive drum 41.

Description is made of a formation process for the toner image. The photosensitive drum 41 is driven to rotate in a predetermined direction (clockwise in FIG. 1). The charging device 42 charges a surrounding surface of the photosensitive drum 41. The exposure device 43 irradiates the charged photosensitive drum 41 with light (for example, laser light) based on the image data, scans/exposes the surrounding surface, and forms an electrostatic latent image corresponding to the image data on the surrounding surface of the photosensitive drum 41. The developing device 44 charges toner, supplies the charged toner to the electrostatic latent image, and develops the electrostatic latent image as the toner image. The transfer roller 45 is rotatably supported, and forms a nip by being brought into press contact with the photosensitive drum 41. When the sheet and the toner image enter the nip, a voltage of a polarity reverse to a charging polarity of the toner is applied to the transfer roller 45. Accordingly, the toner image is transferred onto the sheet. In FIG. 1, the cleaning device 46 is located above the photosensitive drum 41, and removes and recovers residual toner, refuse, and the like from the surrounding surface of the photosensitive drum 41.

In this embodiment, the fixing device 1 includes: a heating roller 11 (corresponding to a heating body) incorporating a heater H that generates heat when a current is applied thereto; and a pressure roller 12 (corresponding to a pressure body). In order to heat the toner image, the heating roller 11 is heated by the heat generated by the heater H, and is caused to rotate. Note that the heater H, which extends in an axis direction of the heating roller 11, may heat an entire surrounding surface of the heating roller 11. Further, a unit that may heat the heating roller 11, for example, a halogen heater, may be used as the heater H. The pressure roller 12 is caused to rotate in contact with the heating roller 11, and forms a nip that the sheet having the toner image transferred thereonto is allowed to enter.

Then, the sheet enters the nip, and the toner image is pressurized/heated and fixed to the sheet. The sheet that has undergone the fixation is discharged to the discharge tray 31. Note that a plurality of contact temperature sensors 5 (corresponding to a temperature sensor units) including a thermistor TH (corresponding to a temperature sensing element) that is in contact with the heating roller 11 and is covered with a protective tape 51 (corresponding to a protective member) are provided in order to sense the temperature of the heating roller 11 (fixing device 1). Also provided is a non-contact temperature sensor 5C (corresponding to a non-contact temperature sensor unit) for sensing the temperature of the heating roller 11 in a non-contact manner (which is described later in detail).

Note that as indicated by the broken line in FIG. 1, the printer 100 of this embodiment includes, on the top left side of the front view, an operation panel 6 (corresponding to a notification unit) that issues a notification of a state of a device. The operation panel 6 includes a liquid crystal display unit 61, a plurality of indicators 62, and a plurality of operation keys 63. The liquid crystal display unit 61 displays various kinds of messages such as a service call (notification that the printer 100 needs a checkup/repair to be made by a service person who performs maintenance thereof), a failure occurrence, and an error message. Each of the plurality of indicators 62 is a light emitting element (for example, LED), and the printer 100 of this embodiment is provided with three indicators 62. The plurality of indicators 62 light up or blink, to thereby display the various kinds of messages such as the service call, the failure occurrence, printing underway, and the error occurrence such as a paper-out condition. Note that the operation panel 6 may issue a notification of a message regarding the fixing device 1 in terms of the above-mentioned items, and hence functions as the notification unit for the fixing device 1 as well.

(Hardware Configuration of the Printer 100)

Figure 2:
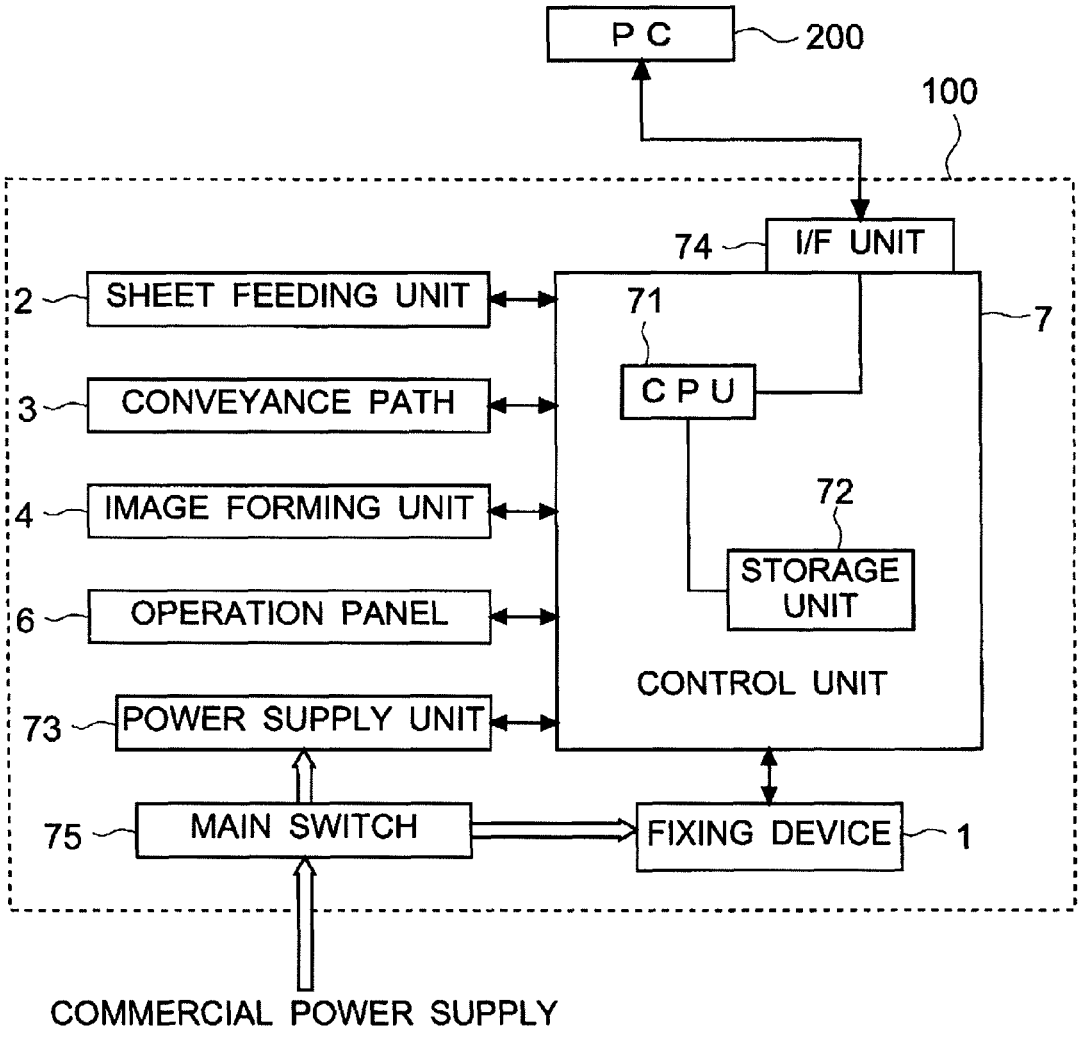
FIG. 2 is a block diagram of an example of a hardware configuration of the printer according to the first embodiment.

Next, with reference to FIG. 2, description is made of an example of a hardware configuration of the printer 100 according to the first embodiment of the present invention. FIG. 2 is a block diagram of the example of the hardware configuration of the printer 100 according to the first embodiment of the present invention.

First, as illustrated in FIG. 2, the printer 100 of this embodiment includes a control unit 7 that supervises control of an entire operation of the printer 100. The control unit 7 includes a central processing unit (CPU) 71. Further, the control unit 7 may control the fixing device 1 by, for example, recognizing the temperature of each part of the heating roller 11 based on a signal received from each of the temperature sensors 5 and judging that a failure has occurred if the temperatures are different from each other by a fixed value or larger. Accordingly, the control unit 7 functions as not only the control unit 7 for the printer 100 but also the control unit 7 for the fixing device 1. Note that a control unit (controller) dedicated to the fixing device 1 may be provided.

Further, the control unit 7 includes a storage unit 72 that includes a random access memory (RAM), a read only memory (ROM), and a flash ROM and stores data. For example, the ROM and the flash ROM store programs and data necessary to perform various kinds of control, in a non-volatile manner. Meanwhile, for example, the RAM temporarily expands programs and data that are used for control, the image data, and the like.

Further, the control unit 7 is connected to the sheet feeding unit 2, the conveyance path 3, the image forming unit 4, the fixing device 1, a power supply unit 73, the operation panel 6, and the like via a signal line, a bus, or the like. The control unit 7 performs operation control on each of the units connected thereto. Further connected to the control unit 7 is an interface unit 74 (I/F unit) including a connector and a socket that are used for connecting the PC 200 and the printer 100 via a network or a cable. The use of the I/F unit 74 allows the PC 200 and the printer 100 to perform communications with each other via the network or the like. Then, the printer 100 of this embodiment performs printing in response to the transmission of the image data and print setting data from the PC 200.

Note that the printer 100 of this embodiment includes the power supply unit 73 connected to a commercial power supply. Further, the power supply unit 73 performs rectification, voltage boost, voltage reduction, or the like to supply power to a substrate of the control unit 7 or the like, the image forming unit 4, a motor for the sheet conveyance, and the like. Further, the power supply unit 73 may supply power to the heater H and the like of the fixing device 1. For example, the power supply unit 73 may function as a switch that connects the commercial power supply to the heater H, or may supply the power subjected to the rectification, the voltage boost, or the voltage reduction to the heater H. Further, for example, a main switch 75 may be provided. The main switch 75 allows a user to turn on/off main power by turning on/off the connection between the commercial power supply and the power supply unit 73.

(Placement Position and Structure of Each Temperature Sensor 5)

Figure 3A:
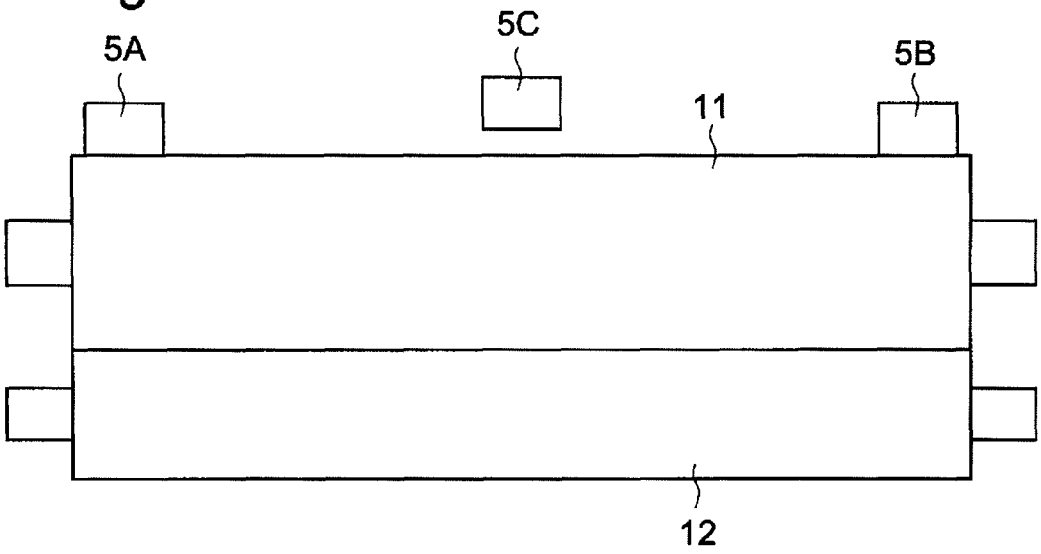
FIG. 3A illustrates an example of a layout of temperature sensors according to the first embodiment.
Figure 3B:
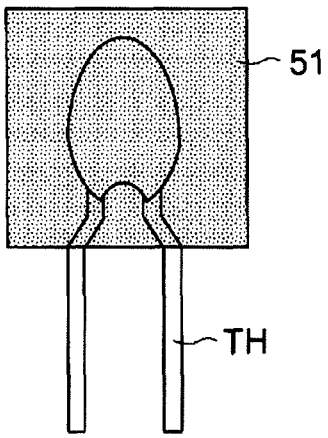
FIG. 3B illustrates an example of a thermistor inside a contact temperature sensor according to the first embodiment.
Figure 3C:
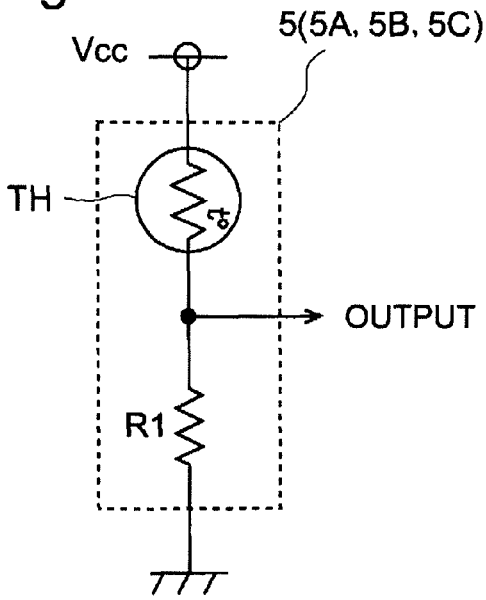
FIG. 3C illustrates an example of a circuit of each of the temperature sensors according to the first embodiment.

Next, with reference to FIGS. 3A to 3C, description is made of an example of a layout of the respective temperature sensors 5 and a structure of each of the temperature sensors 5 in the fixing device 1 according to the first embodiment of the present invention. FIG. 3A illustrates an example of the layout of the respective temperature sensors 5 according to the first embodiment of the present invention. FIG. 3B illustrates an example of the thermistor TH inside the contact temperature sensor 5 according to the first embodiment of the present invention. FIG. 3C illustrates an example of a circuit of each of the temperature sensors 5 according to the first embodiment of the present invention.

First, as illustrated in FIG. 3A, in the fixing device 1 of this embodiment, the heating roller 11 and the pressure roller 12 have substantially the same length. For example, the length of each of the heating roller 11 and the pressure roller 12 is set to a length that allows a sheet of A3 paper to pass in a cross direction thereof (short side of the sheet of A3 paper is shorter than an axis-direction length of the surrounding surface of each roller). Then, the pressure roller 12 is in press contact with the heating roller 11, and the axis directions of the heating roller 11 and the pressure roller 12 are parallel to each other. Then, the sheet having the toner image transferred thereonto enters the nip between the heating roller 11 and the pressure roller 12. Further, normally in the fixing device 1, the sheet is conveyed by center sheet passing.

The fixing device 1 of this embodiment is provided with at least two temperature sensors of a temperature sensor 5A and a temperature sensor 5B (which may be three or more) in contact with the heating roller 11. The temperature sensor 5A and the temperature sensor 5B are located at both end portions of the axis direction of the heating roller 11. That is, the temperature sensor 5A and the temperature sensor 5B sense temperatures of the heating roller 11 in end positions in the axis direction. Note that the temperature sensor 5A and the temperature sensor 5B may have the same specifications and the same format, and if not particularly distinguished, are referred to simply as "temperature sensor 5" by omitting "A" and "B". Meanwhile, the non-contact temperature sensor 5C is opposed to the heating roller 11 in substantially the center position of the heating roller 11 in the axis direction. Then, the non-contact temperature sensor 5C senses the temperature of the center part of the heating roller 11 in the axis direction.

For example, the non-contact temperature sensor 5C is a sensor used for checking whether or not the temperature of the center part of the heating roller 11 exceeds or maintains a fixing temperature before or during the printing. Further, for example, the contact temperature sensors 5A and 5B are each a sensor used not only for sensing the temperature of the heating roller 11, but also for sensing the one-sided sheet conveyance and the occurrence of excessive temperature rises at the end portions of the heating roller 11 or the like undergoing continuous printing of the sheets of a small size.

As illustrated in FIG. 3B, the temperature sensor 5A and the temperature sensor 5B each include the thermistor TH serving as the temperature sensing element. Each of the thermistors TH is supported so as to be in contact with the heating roller 11 by causing, for example, metal terminals (both legs) thereof to be bent on the heating roller 11. Further, in order to prevent wear or the like due to the contact with the heating roller 11, a surface of each of the thermistors TH is protected by the protective tape 51 (corresponding to a protective member). Note that the thermistor TH is similarly provided inside the non-contact temperature sensor 5C as the temperature sensing element, but the protective tape 51 is unnecessary for the thermistor TH provided inside the non-contact temperature sensor 5C.

Examples that may be used as the protective tape 51 include a tape having insulating properties and wear resistance, such as a Kapton (registered trademark) tape. For example, the protective tape 51 is coated with pressure sensitive adhesive on one side, has such a size as to be able to wrap the thermistor TH, and is folded so as to sandwich the thermistor TH. Accordingly, the thermistor TH is covered with the protective tape 51 and is protected against wear or the like.

Further, FIG. 3C is a basic circuit diagram of each of the temperature sensor 5A, the temperature sensor 5B, and the non-contact temperature sensor 5C. As illustrated in FIG. 3C, for example, the thermistor TH of each of the temperature sensors 5 is connected to a power supply Vcc (supply from, for example, the power supply unit 73). In addition, a resistor R1 is connected to one end of the thermistor TH and to the ground. A voltage of a series circuit between the thermistor TH and the resistor R1 is extracted as an output from each of the temperature sensors 5.

Examples that may be used as each of the thermistors TH include a negative temperature coefficient (NTC) thermistor exhibiting a smaller resistance value with higher temperature. With the NTC thermistor, as the temperature rises, a combined resistance value of the series circuit becomes smaller, causing a current to flow with more ease, and hence the voltage serving as the output from the temperature sensor 5 becomes higher. Note that a positive temperature coefficient (PTC) thermistor exhibiting a larger resistance value with higher temperature may be used as the thermistor TH.

Here, the resistance value of the thermistor TH with respect to the temperature is defined for every format of the thermistor TH, such as a data sheet. Assuming that the resistance value of the resistor R1 within the temperature sensor 5 is a fixed value, the resistance value of the thermistor TH with respect to values of the voltage Vcc (power supply) and the voltage serving as the output from the temperature sensor 5 may be obtained by the CPU 71 or the like through calculation based on a divided voltage ratio. A relationship of the temperature with the resistance value of the thermistor TH is stored in the storage unit 72 in the form of a table such as the data sheet or the like, and the control unit 7 may sense and recognize the temperature of the heating roller 11 based on the resistance value of the thermistor TH.

Alternatively, the resistance value of the thermistor TH with respect to the temperature always indicates a substantially constant value with the same temperature, and hence there is a correlation between the temperature of the heating roller 11 and the value of the voltage serving as the output from each of the temperature sensors 5. Therefore, the value of the voltage serving as the output from each of the temperature sensors 5 with respect to the temperature is grasped in advance. In addition, the relationship between the temperature and the voltage serving as the output is stored in the storage unit 72 in the form of a table. Accordingly, for example, the control unit 7 may sense and recognize the temperatures at both ends and a center portion of the heating roller 11 by referencing the value of the voltage serving as the output from each of the temperature sensors 5 and the table.

Note that each of the temperature sensors 5 may have a memory or the like mounted thereon, and may output digital data indicating the temperature. In this case, the control unit 7 receives an input of data indicating the temperature, and recognizes the temperature of the heating roller 11 based on the input temperature.

(Hardware Configuration of the Fixing Device 1)

Figure 4:
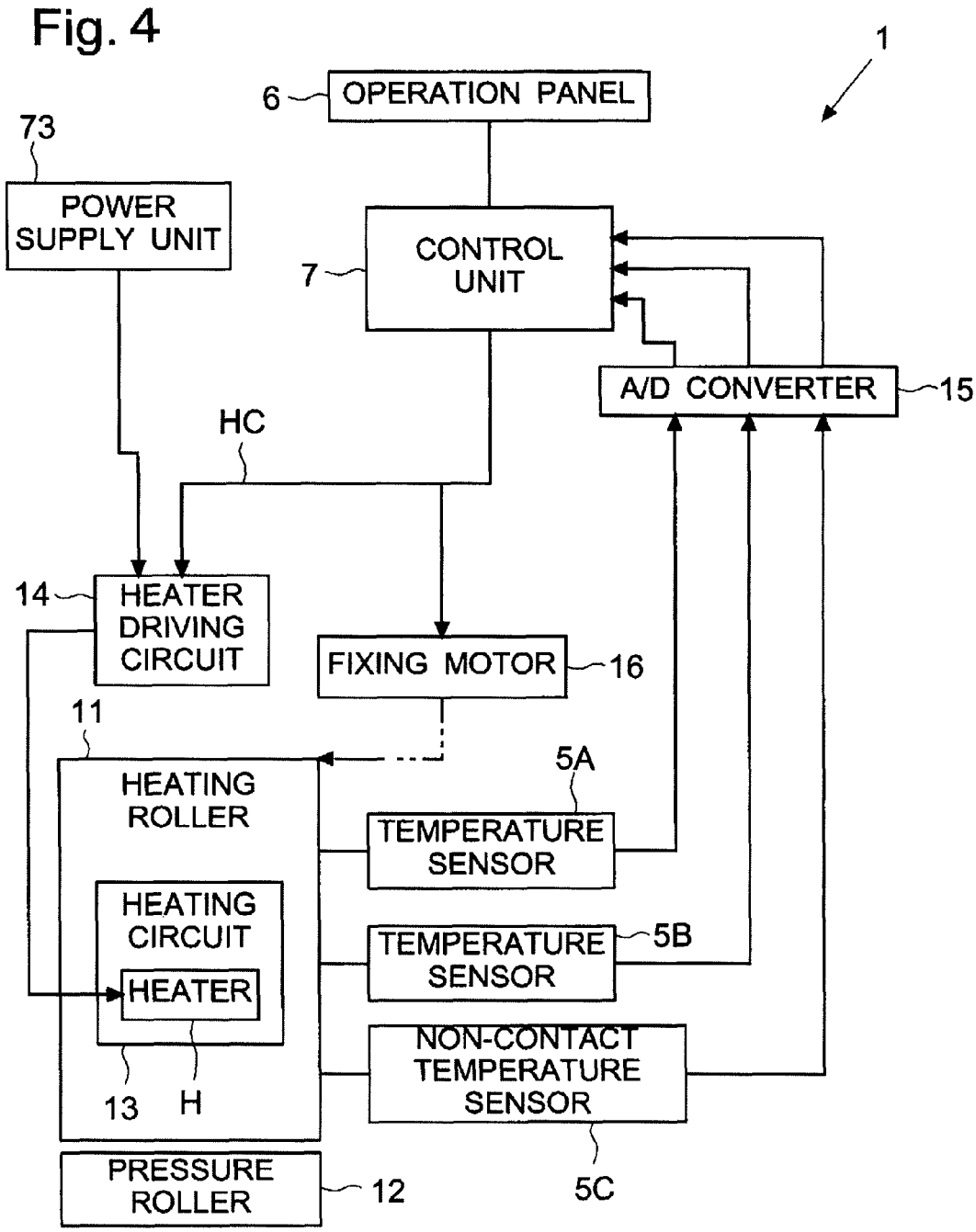
FIG. 4 is a block diagram illustrating an example of a hardware configuration of a fixing device according to the first embodiment.

Next, with reference to FIG. 4, description is made of an example of a hardware configuration of the fixing device 1 according to the first embodiment of the present invention. FIG. 4 is a block diagram of the example of the hardware configuration of the fixing device 1 according to the first embodiment of the present invention.

As illustrated in FIG. 4, the printer 100 of this embodiment includes a heating circuit 13 including the heater H inside the heating roller 11. For example, a temperature fuse, a thermal protector, a thermostat, or the like may be incorporated into the heating circuit 13, and if there occurs an excessive temperature rise enough to be sensed by the temperature fuse or the like, the heating circuit 13 is forcibly judged to be in a wire break state.

Also provided is a heater driving circuit 14 that switches on/off of electrification to the heater H of the heating circuit 13. A heater control signal line HC extending from the control unit 7 is connected to the heater driving circuit 14. The control unit 7 inputs a heater driving control signal that instructs ON/OFF control of the electrification to the heater H, to the heater driving circuit 14 through the heater control signal line HC. An ON/OFF state of the heater H is thus controlled.

The temperature sensor 5A, the temperature sensor 5B, and the non-contact temperature sensor 5C are different from one another in analog voltage output therefrom depending on the temperature of the heating roller 11. Therefore, an analog to digital (A/D) converter 15 may be provided between the control unit 7 and the temperature sensor 5A, the temperature sensor 5B, and the non-contact temperature sensor 5C. An output from the A/D converter 15 is input to, for example, the CPU 71 of the control unit 7 as a signal. The control unit 7 may thus recognize the temperatures at both the end portions and the center portion of the heating roller 11. Note that if the CPU 71 of the control unit 7 includes a port for A/D conversion, the A/D converter 15 may not be provided.

Based on those sensed temperatures, the control unit 7 performs ON/OFF control of the heater H. For example, in the case of performing printing, the control unit 7 maintains the heating roller 11 at a temperature suitable for fixation of the toner image (hereinafter, referred to as "fixing temperature"; for example, approximately 200° C.). For example, if the temperature of the heating roller 11 exceeds 200° C., the control unit 7 turns off (interrupts the current to) the heater H, and if the temperature becomes lower than 200° C., turns on (supplies the current to) the heater H.

Further, in the fixing device 1 of this embodiment, while sheets are conveyed by the center sheet passing, if the printing is continuously performed on the sheets (of, for example, B5 size) having a width narrower than the length of the heating roller 11 in the axis direction, the temperature drops only in the center part of the heating roller 11 that is in contact with the sheets. If the printing is further continued, the heater H needs to be in the ON state in order to maintain the center part of the heating roller 11 at the fixing temperature. However, the temperatures of the heating roller 11 at both the ends continue to rise. Accordingly, in the case where the printing is continuously performed on the sheets of a small size, the temperatures may rise to a level too much higher than the fixing temperature at both the ends of the heating roller 11 and both the ends of the pressure roller 12 to which the heat of the heating roller 11 is conducted.

The state in which the temperatures rise too high at both the end portions of each roller may be sensed based on the fact that, for example, the temperatures sensed by using the temperature sensor 5A and the temperature sensor 5B exceed a predefined temperature (for example, 250° C. or higher, which varies depending on the specifications of the fixing device 1). In this case, the control unit 7 controls the sheet feeding unit 2 and the image forming unit 4 to stop sheet feeding and image formation, respectively, and to cause the heating roller 11 and the pressure roller 12 to keep rotating for a fixed period of time. This allows the heat at both the end portions of the heating roller 11 to be conducted, which cancels the state in which the temperatures are too high at the end portions of the heating roller 11 and the like. Note that the control unit 7 may control the rotation of a fixing motor 16 that supplies a rotation driving force to the heating roller 11 and the like, and may cause only the heating roller 11 and the pressure roller 12 to keep rotating while the heater H is kept off.

Further, in the fixing device 1 of this embodiment, the sheet is conveyed by the center sheet passing. However, for such reasons that pressing forces of the pressure roller 12 are uneven and that the levels of the pressing forces are different at both the ends of the heating roller 11 in the axis direction, the sheet is sometimes conveyed with the sheet positioned close to one side of the heating roller 11 in the axis direction. The one-sided sheet conveyance causes a paper jam due to snagging of the sheet or the like. Further, on the heating roller 11, heat is taken by the sheet at one of the end portions that is in contact with the sheet, but the heat is not taken by the sheet at the other end portion that is not in contact with the sheet.

Therefore, a temperature rise may occur at the other end portion that is not in contact with the sheet. In such a case, the temperatures sensed by using the temperature sensor 5A and the temperature sensor 5B exceed a range of an error and exhibit a difference of the fixed value or larger, the control unit 7 judges that one-sided sheet feeding is being performed and the failure has occurred. If it is judged that the failure has occurred, the control unit 7 causes the operation panel 6 to display thereon characters that represent, for example, "fixing device failed".

Here, each of the thermistors TH of the temperature sensor 5A and the temperature sensor 5B is of a contact and is covered with the protective tape 51. However, while being used, a part or an entirety of the protective tape 51 may peel off due to, for example, the friction with the heating roller 11. If the protective tape 51 peels off and then the thermistor TH is brought into direct contact with the heating roller 11, the value of the voltage serving as the output from the temperature sensor 5 with respect to the temperature may be changed in comparison with a state in which the protective tape 51 has not peeled off.

In general, the thermistor TH from which the protective tape 51 has peeled off is brought into direct contact with the heating roller 11. Accordingly, the heat of the heating roller 11 is conducted directly to the thermistor TH from which the protective tape 51 has peeled off. Meanwhile, the thermistor TH from which the protective tape 51 has not peeled off is in indirect contact with the heating roller 11 via the protective tape 51. In other words, the thermistor TH from which the protective tape 51 has not peeled off has a larger distance from the heating roller 11 than the thermistor TH from which the protective tape 51 has peeled off.

Accordingly, the temperature sensed by using the thermistor TH from which the protective tape 51 has peeled off is higher than the temperature sensed by using the thermistor TH from which the protective tape 51 has not peeled off. Here, with the state in which the protective tape 51 has not peeled off as a reference, the table or the like that defines the temperature of the heating roller 11 with respect to the voltages output from the respective temperature sensors 5 and the resistance values of the thermistors TH obtained based on the output voltages is stored in the storage unit 72, and the control unit 7 references the table or the like to sense the temperature. Accordingly, the temperature sensor 5 in which the protective tape 51 has peeled off exhibits a temperature deviated from (higher than) the temperature to be sensed.

Meanwhile, in the printer 100 of this embodiment and the fixing device 1, it is judged that the one-sided sheet feeding is being performed when the temperatures sensed by using the temperature sensor 5A and the temperature sensor 5B exhibit a temperature difference of the fixed value or larger. If the protective tape 51 has peeled off in one of the temperature sensor 5A and the temperature sensor 5B, it may be erroneously sensed that the one-sided sheet feeding is being performed.

The fixing device 1 in which the one-sided conveyance of the sheet is performed due to the problems such as the rise in occurrence ratio of a paper jam and the rise in temperature at an end portion should be regarded as having failed. On the other hand, the peeling off of the protective tape 51 is not enough to require replacement of the fixing device 1 because sticking of the protective tape 51 again or correction of the sensed temperature may suffice.

Figure 5:
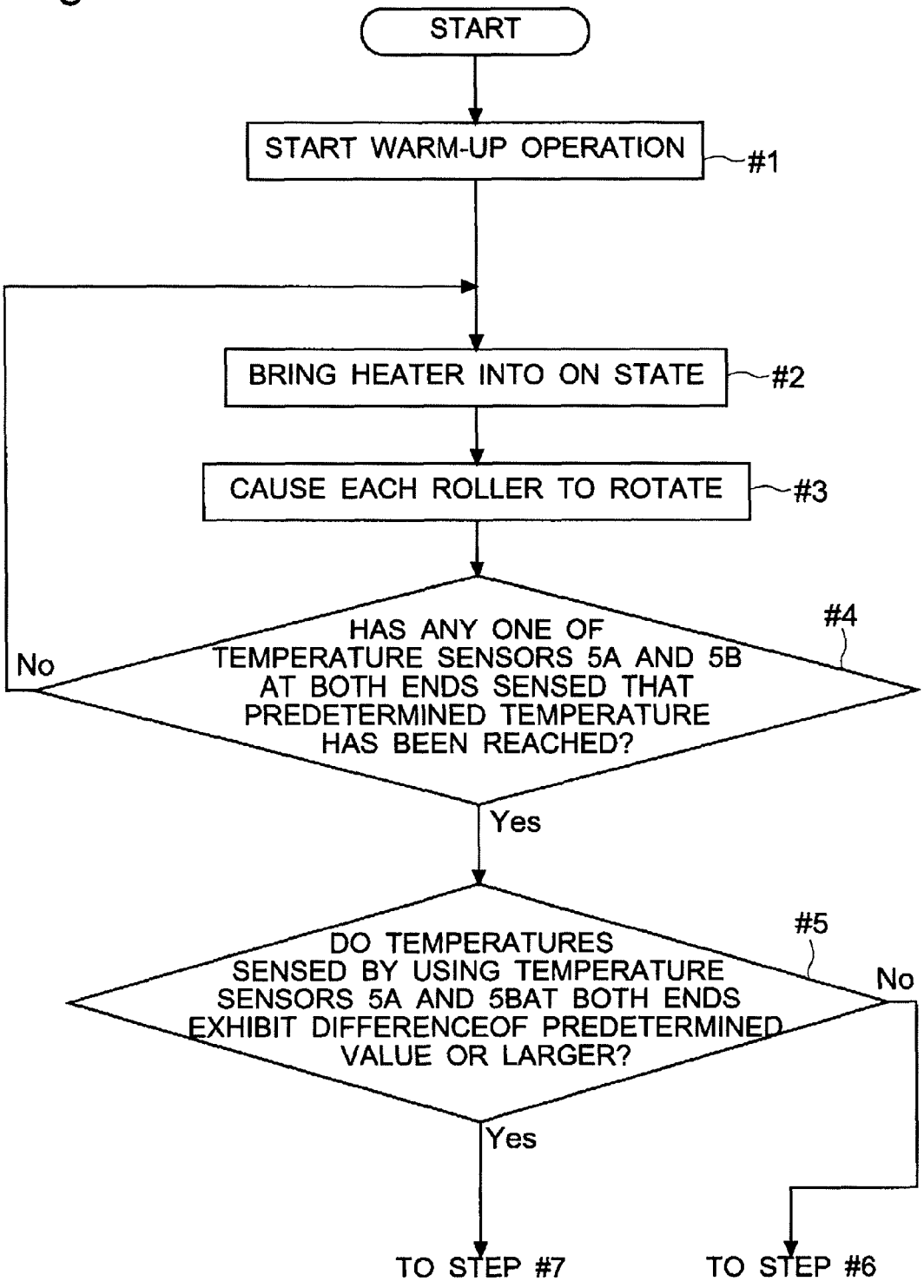
FIG. 5 is a flowchart illustrating an example of acknowledgment control for the temperature sensor including a thermistor from which a protective tape has peeled off, according to the first embodiment.
Figure 6:
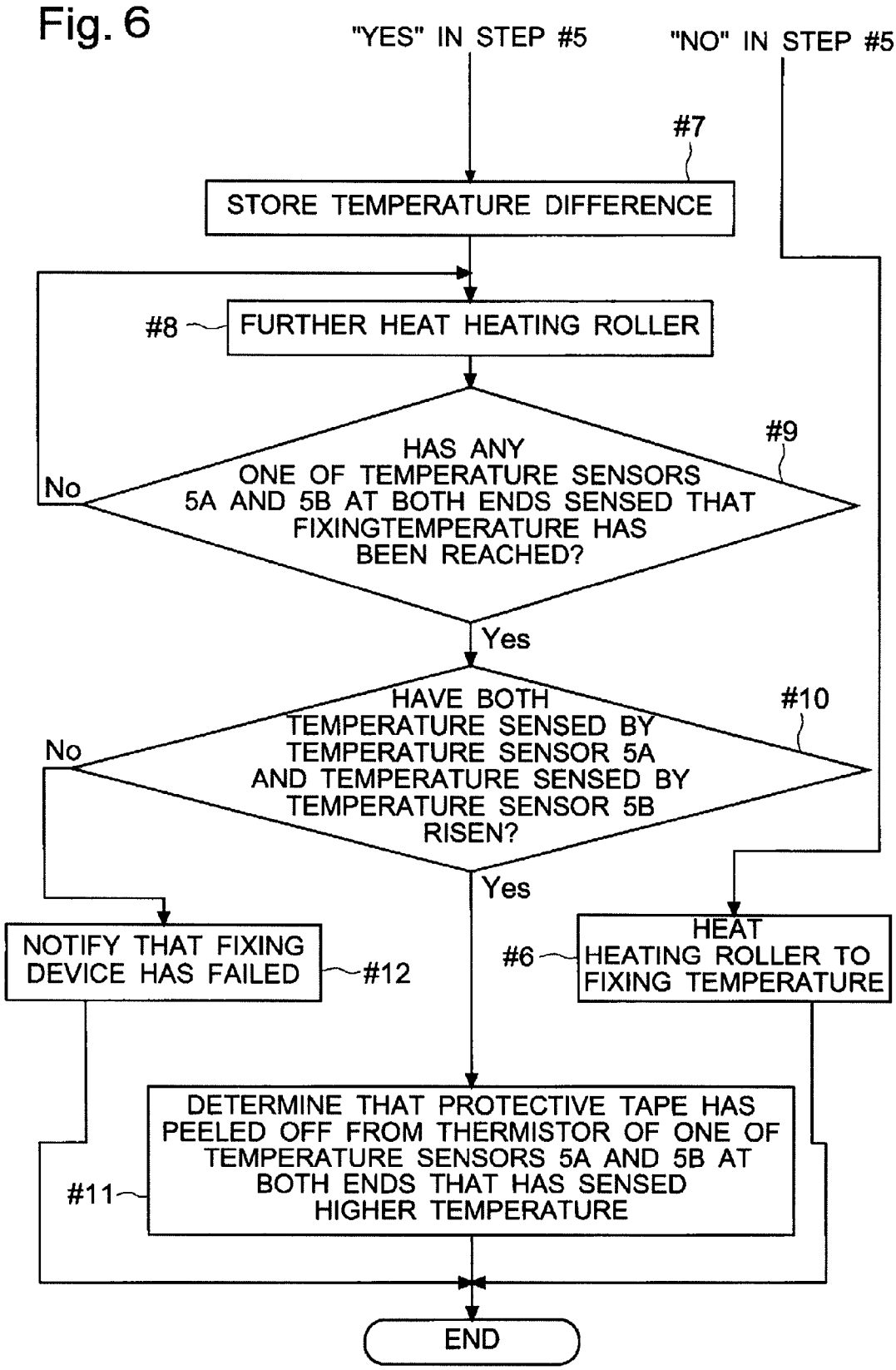
FIG. 6 is a flowchart illustrating the example of the acknowledgment control for the temperature sensor including the thermistor from which the protective tape has peeled off, according to the first embodiment.
Figure 7:
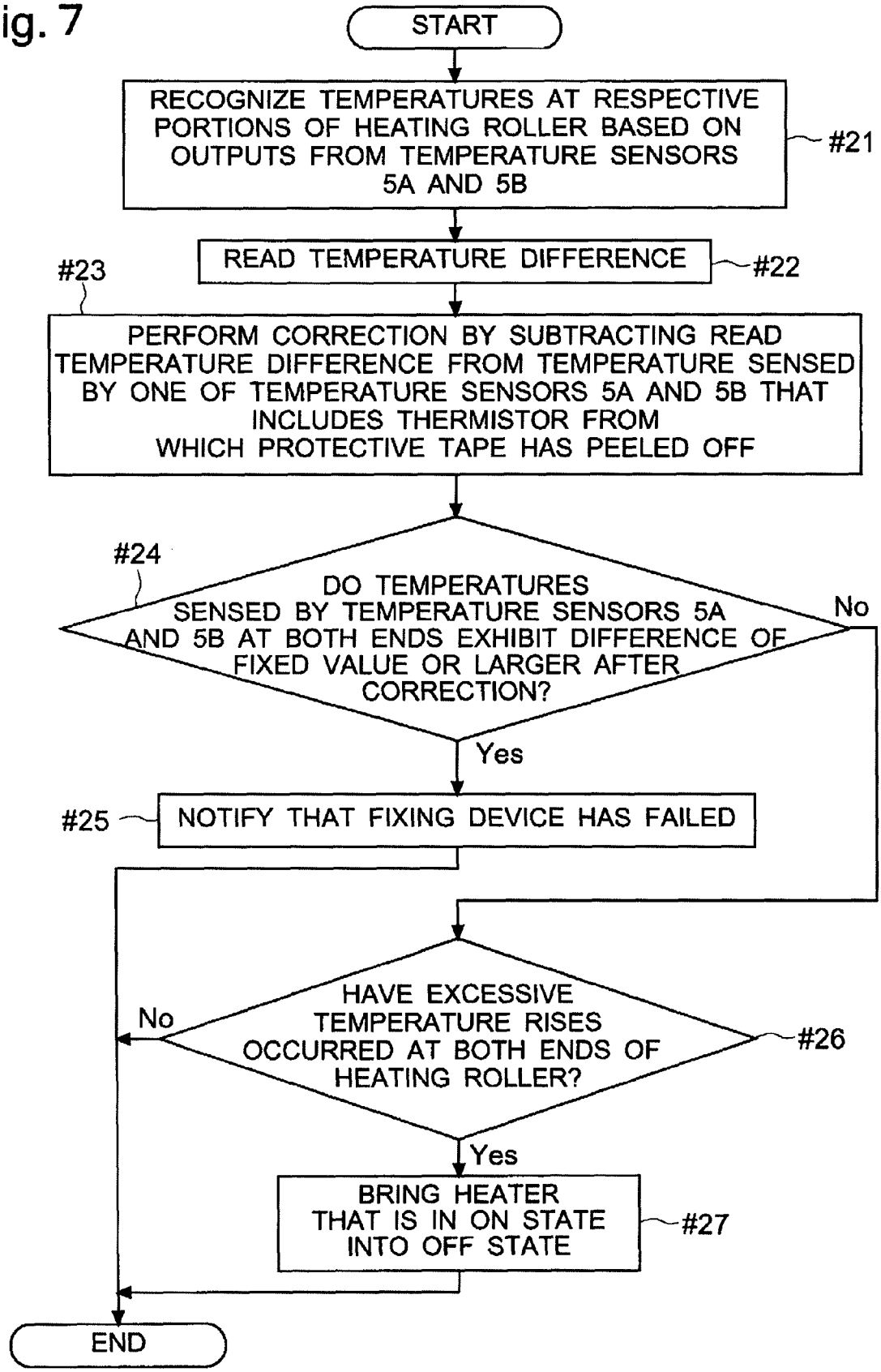
FIG. 7 is a flowchart illustrating an example of correction of a temperature sensed by using the temperature sensor determined to include the thermistor from which the protective tape has peeled off; according to the first embodiment.

Conventionally, if the protective tape 51 has peeled off, the one-sided sheet conveyance is erroneously sensed in the fixing device 1 and the fixing device 1 may be replaced. In view of this, according to the first embodiment of the present invention, the temperature sensor 5 in which the protective tape 51 has peeled off is determined, and correction is performed on the temperature of the heating roller 11 obtained by using the temperature sensor 5 in which the protective tape 51 has peeled off. With reference to FIG. 5 to FIG. 7, description is made of an example of the acknowledgment of the temperature sensor 5 in which the protective tape 51 has peeled off from the thermistor TH and an example of the correction of the temperature sensed by the temperature sensor 5.

(Acknowledgment of the Temperature Sensor 5 Including the Thermistor TH from which the Protective Tape 51 has Peeled Off)

As described above, with reference to FIG. 5 and FIG. 6, description is made of an example of acknowledgment control of the temperature sensor 5 including the thermistor TH from which the protective tape 51 has peeled off, according to the first embodiment of the present invention. FIG. 5 and FIG. 6 are flowcharts illustrating the example of the acknowledgment control for the temperature sensor 5 including the thermistor TH from which the protective tape 51 has peeled off, according to the first embodiment of the present invention. FIG. 5 and FIG. 6 are two separate diagrams of a series of control for the acknowledgment of the temperature sensor 5 including the thermistor TH from which the protective tape 51 has peeled off, according to the first embodiment. Note that in this embodiment, description is made of control for determining the temperature sensor 5 including the thermistor TH from which the protective tape 51 has peeled off by using only the temperature sensor 5A and the temperature sensor 5B.

First, in this description, an example of the control at a time of turning on the main power is described. Therefore, the flowchart illustrated in FIG. 5 begins at the time of turning on the main power to the printer 100. When the main switch 75 is turned on by turning on the main power, the power supply unit 73 generates various kinds of voltages, which are supplied to the control unit 7 and the like. As a result, a warm-up operation is started in order to cause the printer 100 to be ready for printing (Step #1). Then, the control unit 7 brings the heater H into an ON state (Step #2). After that, in order to uniformly conduct the heat of the heater H to the heating roller 11 and the pressure roller 12 and heat the fixing device 1 on the whole, the control unit 7 causes the heating roller 11 and the pressure roller 12 to rotate (Step #3).

Subsequently, the control unit 7 checks whether or not any one of the temperature sensor 5A and the temperature sensor 5B has sensed that a predetermined temperature has been reached (Step #4). In other words, the control unit 7 checks the temperatures sensed by using the temperature sensor 5A and the temperature sensor 5B, and checks whether or not one of the temperatures sensed by using the temperature sensors 5A and 5B has become equal to or higher than the predetermined temperature (has exceeded the predetermined temperature). Here, the predetermined temperature represents a temperature lower than the fixing temperature (for example, 100° C. to 150° C.). In view of change characteristics of the resistance values of the respective thermistors TH, the predetermined temperature may be set as a temperature at which a rate of change in resistance values of the respective thermistors TH has increased to a certain degree and the deviation in sensed temperature becomes apparent due to the fact that the protective tape 51 has peeled off. For example, in a case where the heating body is heated to approximately 200° C. after the main power is turned on, the predetermined temperature may be set to approximately 100° C.

Note that the control unit 7 may judge whether or not the predetermined temperature has been reached by using the temperature sensor 5A or by using the temperature sensor 5B. However, there may be a case where a wire break or the like has occurred, and hence if any one of the temperature sensor 5A and the temperature sensor 5B has sensed earlier that the predetermined temperature has been reached, the control unit 7 judges that the predetermined temperature has been reached. This may reliably prevent the heating roller 11 from being heated too much as well.

If none of the temperature sensor 5A and the temperature sensor 5B cannot sense that the predetermined temperature has been reached ("No" in Step #4), the procedure returns to, for example, Step #2. On the other hand, if any one of the temperature sensor 5A and the temperature sensor 5B may sense that the predetermined temperature has been reached ("Yes" in Step #4), the control unit 7 checks whether or not the temperatures sensed by using the temperature sensors 5 at both the ends of the heating roller 11, that is, the temperature sensor 5A and the temperature sensor 5B, exhibit the difference of a predetermined value or larger (Step #5).

Here, it is checked whether or not the temperatures exhibit the difference of the predetermined value or larger in order to check whether or not the protective tape 51 has peeled off by referencing the temperature sensed by using the temperature sensor 5A and the temperature sensed by using the temperature sensor 5B. The predetermined value may be defined based on a difference between the temperatures sensed by using the respective temperature sensors 5 that have been used when objects with the same temperature are measured in a previous experiment or the like by using the temperature sensor 5 including the thermistor TH from which the protective member has peeled off and the temperature sensor 5 including the thermistor TH from which the protective member has not peeled off. Note that because heating by the heater H may be uneven, the predetermined value is set to a value that exceeds an error of the temperature that may be generated when none of the protective tapes 51 have peeled off in the temperature sensor 5A and the temperature sensor 5B. In the case where the error of the sensed temperature of, for example, approximately 1° C. to 3° C. may be generated even when none of the protective tapes 51 have peeled off in the temperature sensor 5A and the temperature sensor 5B, the predetermined value is set to a value that exceeds 3° C.

If the temperatures sensed by using the temperature sensor 5A and the temperature sensor 5B and recognized by the control unit 7 do not exhibit the difference of the predetermined value or larger (if the difference is less than the predetermined value; "No" in Step #5), it may be judged that the protective tape 51 has not peeled off, and hence the control unit 7 heats the heating roller 11 to the fixing temperature (Step #6). After that, the warm-up operation at the time of turning on the main power is brought to an end. After that, for example, unless the control unit 7 shifts to a power-saving mode, the control unit 7 repeatedly turns on/off the heater H and shifts to control for maintaining the temperature of the heating roller 11 at the fixing temperature.

On the other hand, if the temperatures sensed by using the temperature sensor 5A and the temperature sensor 5B and recognized by the control unit 7 exhibit the difference of the predetermined value or larger ("Yes" in Step #5), the control unit 7 stores the temperature difference into, for example, the storage unit 72 (Step #7). That is, the control unit 7 stores the temperature difference when any one of the temperature sensors 5 has sensed that the heating roller 11 has been heated to the predetermined temperature after the heater H enters into the ON state through turning on of the main power that starts power supply to the fixing device 1. Further, if the temperature difference is equal to or larger than the predetermined value, there may have been an occurrence of the wire break in the signal line that extends from the temperature sensor 5 to the A/D converter 15 and the control unit 7 in addition to the peeling off of the protective tape 51. In order to confirm those factors, the control unit 7 brings the heater H into an ON state and further heats the heating roller 11 from the predetermined temperature to the fixing temperature (Step #8).

Then, the control unit 7 confirms whether or not the heating roller 11 has been heated to the fixing temperature (Step #9). Specifically, the control unit 7 checks whether or not any one of the temperature sensor 5A and the temperature sensor 5B has sensed that the fixing temperature has been reached (Step #9). In other words, the control unit 7 checks the temperatures sensed by using the temperature sensor 5A and the temperature sensor 5B and checks whether or not any one of the temperatures sensed by using the temperature sensors 5A and 5B has become equal to or higher than the fixing temperature (exceeds the fixing temperature).

If there is no change in sensed temperature, there may have been the occurrence of the wire break. Therefore, it may be judged that the heating roller 11 has been heated to the fixing temperature based on one of the temperature sensor 5A and the temperature sensor 5B that exhibits a change in sensed temperature. To this end, if any one of the temperature sensor 5A and the temperature sensor 5B has sensed earlier that the fixing temperature has been reached, the control unit 7 judges that the fixing temperature has been reached. Note that the temperature sensed by the temperature sensor 5 is generally high when the protective tape 51 has peeled off, and hence it may be judged that the heating roller 11 has been heated to the fixing temperature based on the lower temperature of the temperatures sensed by the temperature sensor 5A and the temperature sensor 5B.

If none of the temperature sensor 5A and the temperature sensor 5B cannot sense that the heating roller 11 has been heated to the fixing temperature ("No" in Step #9), the procedure returns to, for example, Step #8. On the other hand, if any one of the temperature sensor 5A and the temperature sensor 5B may sense that the fixing temperature has been reached (may sense that the heating roller 11 has been almost heated to the fixing temperature) ("Yes" in Step #9), the control unit 7 checks whether or not both the temperature sensed by using the temperature sensor 5A and the temperature sensed by using the temperature sensor 5B have risen in comparison with a time when it was confirmed in Step #4 that the predetermined temperature was reached (Step #10).

If both the temperatures sensed by the temperature sensor 5A and the temperature sensor 5B have risen ("Yes" in Step #10), the temperature sensor 5 including the thermistor TH from which the protective tape 51 has peeled off is determined (Step #11). When the protective tape 51 has peeled off, the temperature sensed by the temperature sensor 5 is higher than in the case where the protective tape 51 has not peeled off. Therefore, the control unit 7 determines that the protective tape 51 has peeled off from the thermistor TH of one of the temperature sensor 5A and the temperature sensor 5B that has sensed a higher temperature (Step #11). In other words, if the protective tape 51 peels off, that is, if the temperature sensed by using the temperature sensor 5 becomes higher than in the case where the protective tape 51 has not peeled off, the control unit 7 determines one of the temperature sensor 5A and the temperature sensor 5B that has sensed a higher temperature as the temperature sensor 5 including the thermistor TH from which the protective tape 51 has peeled off. That is, the control unit 7 determines that the protective tape 51 has peeled off in the temperature sensor 5 that has sensed the highest temperature.

On the other hand, if both the temperatures sensed by the temperature sensor 5A and the temperature sensor 5B have not risen ("No" in Step #10), the wire break may occur in the signal line between the temperature sensor 5A or the temperature sensor 5B and the control unit 7. For example, a voltage (signal) input to the control unit 7 becomes zero. In other words, the rise in temperature may not be sensed by the control unit 7 due to the wire break.

In this case, it may become difficult to maintain the heating roller 11 at the fixing temperature, and further, it may be impossible to sense even the excessive temperature rises at the end portions of the heating roller 11. Hence, if none of the temperature sensor 5A and the temperature sensor 5B senses the rise in temperature, the control unit 7 uses the liquid crystal display unit 61 and the indicators 62 of the operation panel 6 to issue the notification that the fixing device 1 has failed (Step #12 to end).

That is, if the sensed and recognized temperatures exhibit a difference of the predetermined value or larger, the control unit 7 judges that the temperature sensor 5 that does not sense the rise in temperature even if the heater H is brought into an ON state has failed. Then, if the control unit 7 judges that the failure has occurred, the operation panel 6 notifies the user of the failure occurrence. This allows the user to recognize that the fixing device 1 needs to be replaced. Note that when the notification that the fixing device 1 has failed is displayed, the printing is inhibited from being performed on the printer 100.

(Correction of the Sensed Temperature)

Next, with reference to FIG. 7, description is made of an example of correction of the temperature sensed by using the temperature sensor 5 determined to include the thermistor TH from which the protective tape 51 has peeled off, according to the first embodiment of the present invention. FIG. 7 is a flowchart illustrating the example of the correction of the temperature sensed by using the temperature sensor 5 determined to include the thermistor TH from which the protective tape 51 has peeled off, according to the first embodiment of the present invention.

Note that this description is directed to an example of control in the case where it is determined in Step #11 of FIG. 6 that the temperature sensor 5 including the thermistor TH from which the protective tape 51 has peeled off exists. Here, the description is made by taking an example of control for preventing the excessive temperature rises at both the end portions of the heating roller 11 and the like at the printing of the sheet of a small size, which includes the sensing of the abnormal one-sided sheet conveyance. Note that the control for correcting the temperature may be performed in control for maintaining the fixing temperature of the heating roller 11. Further, the flowchart illustrated in FIG. 7 represents a flow of the temperature sensing per cycle, and each time the temperature sensing is performed, the control in the flowchart of FIG. 7 is performed.

First, the flowchart of FIG. 7 begins at a start point of the temperature sensing of the heating roller 11. For example, the temperature sensing of the heating roller 11 is performed at the time of the continuous printing or when the temperature maintenance is performed in order to maintain the heating roller 11 at the fixing temperature.

Then, the control unit 7 receives inputs of the output voltages (output signals) from the temperature sensor 5A and the temperature sensor 5B, and recognizes the temperatures at the respective portions of the heating roller 11 (Step #21). At this time, for example, the data table of the storage unit 72 is referenced. Subsequently, the control unit 7 reads the temperature difference stored in Step #7 of FIG. 6 (Step #22). In addition, the control unit 7 performs the correction by subtracting the read temperature difference from the recognized temperature sensed by using one of the temperature sensor 5A and the temperature sensor 5B that includes the thermistor TH from which the protective tape 51 has peeled off (Step #23).

That is, the temperatures sensed by the temperature sensor 5A and the temperature sensor 5B exhibit a difference of the predetermined value or larger, the control unit 7 brings the heater H into an ON state. After that, if the rises in all the temperatures sensed by using the temperature sensors 5 may be recognized, the control unit 7 judges that the protective tape 51 has peeled off, and corrects the recognized temperature sensed by using the temperature sensor 5 determined to have the protective tape 51 which has peeled off therefrom.

Here, based on the output voltages from the respective temperature sensors 5 in which the protective tape 51 has not peeled off, the temperatures of the heating roller 11 are sensed. Then, the sensed temperature becomes higher if the protective tape 51 peels off, and hence the control unit 7 performs the correction by subtracting the temperature difference from the recognized temperature sensed by using the temperature sensor 5 including the thermistor TH from which the protective tape 51 has peeled off. That is, if it is judged that the protective tape 51 has peeled off, the control unit 7 stores the temperature difference between the temperature sensed by using the temperature sensor 5 determined to have the protective tape 51 which has peeled off therefrom and the temperature sensed by using the temperature sensor 5 in which the protective tape 51 has not peeled off, into the storage unit 72, and performs the correction by subtracting the stored temperature difference from the temperature sensed by using the temperature sensor 5 determined to have the protective tape 51 which has peeled off therefrom. The temperature of the heating roller 11 may be thus grasped with accuracy.

Subsequently, the control unit 7 checks whether or not the temperatures sensed by using the temperature sensor 5A and the temperature sensor 5B exhibit the temperature difference of the fixed value or larger even after the correction (Step #24). If the temperatures exhibit the temperature difference of the fixed value or larger ("Yes" in Step #24), it may be judged that the one-sided conveyance of the sheet is being performed, and hence the control unit 7 uses the liquid crystal display unit 61 and the indicators 62 of the operation panel 6 to issue the notification that the fixing device 1 has failed (Step #25). That is, if the respective sensed temperatures are different from each other by the fixed value or larger even after the correction is performed, the control unit 7 judges that the fixing device 1 has failed because the one-sided sheet feeding is being performed. Then, if the control unit 7 judges that the failure has occurred, the operation panel 6 issues the notification of the failure occurrence.

Note that the fixed value may be defined arbitrarily in consideration of heat resistant temperatures or other such factors of the heating roller 11, a gear that drives the heating roller 11, and other such driving mechanism. For example, the fixed value may be defined as a difference (for example, tens to several tens of ° C.) between a temperature which is defined in advance so as not to be exceeded by the temperature at an end portion through which the sheet does not pass in the one-sided conveyance of the sheet and a temperature to be maintained by switching the heater H between the ON/OFF states in order to cause appropriate fixation to be performed during the printing. Further, if the notification that the fixing device 1 has failed is issued, it is not preferred that the printing be continued, and hence the printing is aborted.

On the other hand, if the temperature difference is smaller than the fixed value ("No" in Step #24), there is no problem, and hence the control unit 7 checks the temperature sensed by using the temperature sensor 5A and the temperature sensed by using the temperature sensor 5B and checks whether or not the excessive temperature rises have occurred at both the end portions of the heating roller 11 (Step #26). Note that whether or not the excessive temperature rises have occurred is judged by the control unit 7 based on whether or not the predefined temperature is exceeded in consideration of the heat resistant temperatures or other such factors of the heating roller 11, the gear that drives the heating roller 11, and other such driving mechanism.

If the excessive temperature rise has occurred ("Yes" in Step #26), the heater H that is in an ON state is brought into an OFF state (Step #27 to end). On the other hand, if the excessive temperature rise has not occurred ("No" in Step #26), there is no particular problem, and hence the control for the temperature sensing is brought to an end. After that, for example, based on the sensed temperature recognized by the control unit 7, if the temperature is lower than the fixing temperature, the heater H is brought into an ON state, and if the temperature is equal to or higher than the fixing temperature, the heater H is brought into an OFF state.

(Second embodiment)

Figure 8:
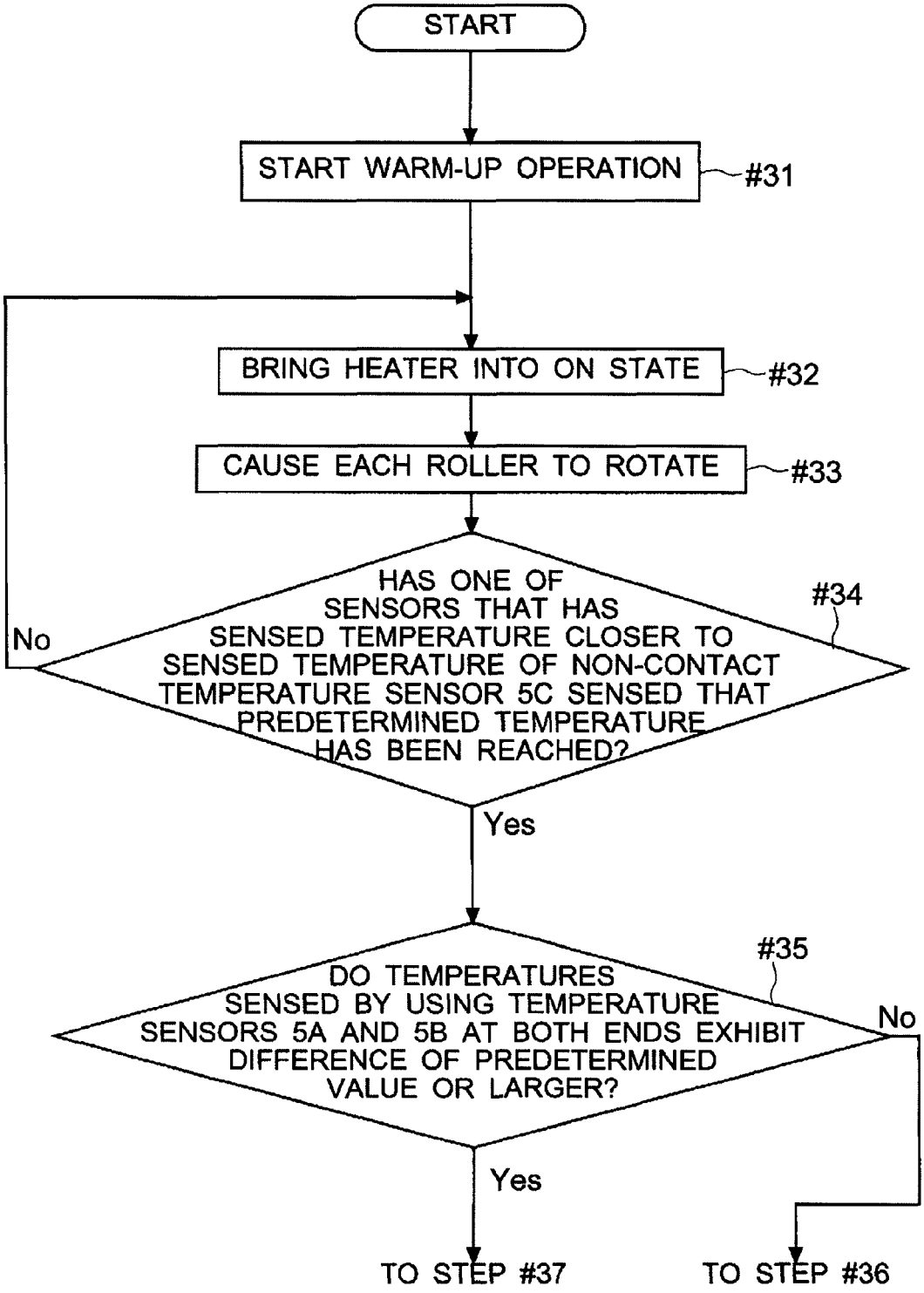
FIG. 8 is a flowchart illustrating an example of acknowledgment control for a temperature sensor including a thermistor from which a protective tape has peeled off, according to a second embodiment of the present invention.
Figure 9:
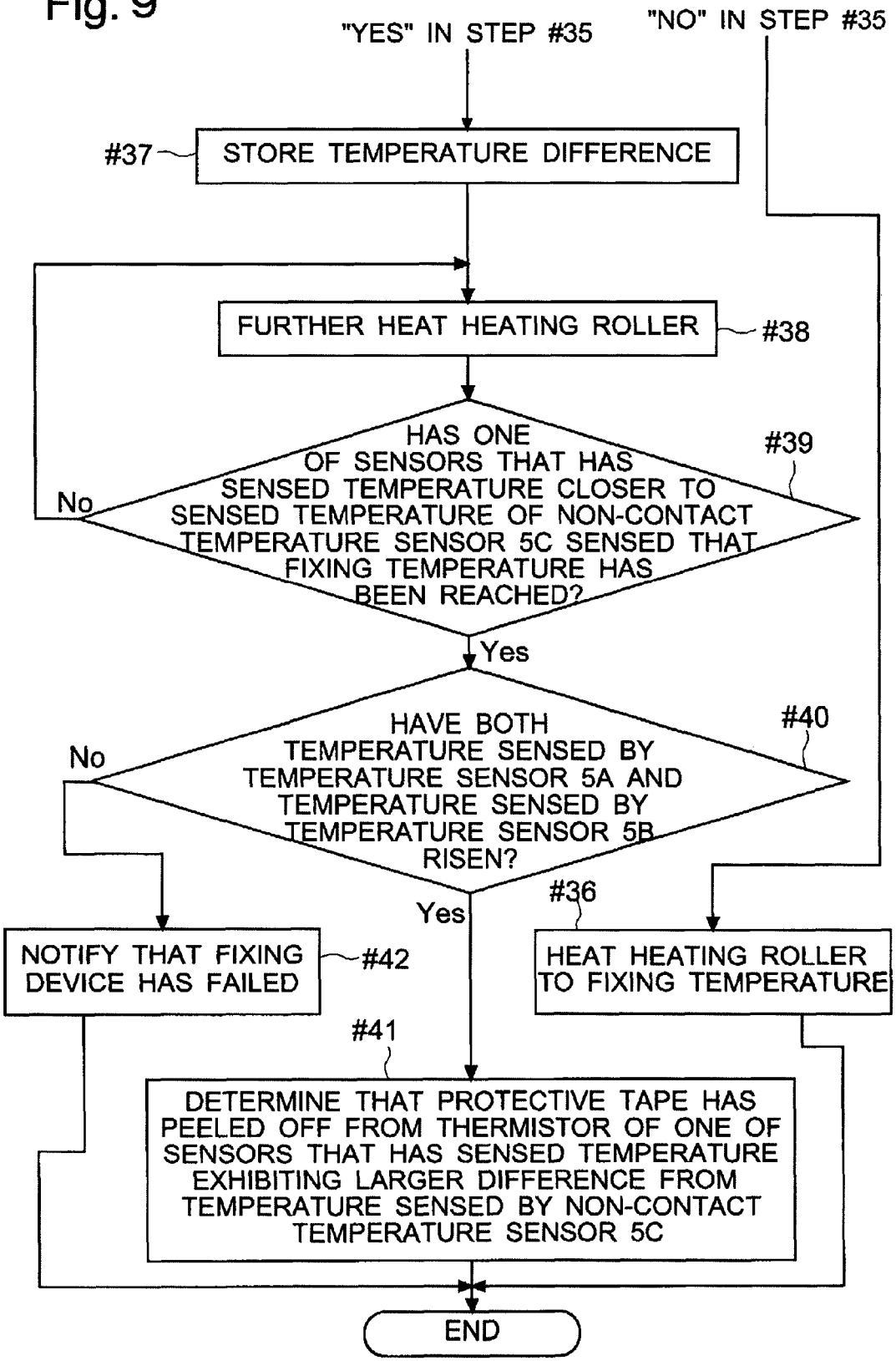
FIG. 9 is a flowchart illustrating the example of the acknowledgment control for the temperature sensor including the thermistor from which the protective tape has peeled off, according to the second embodiment.

Next, with reference to FIG. 8 and FIG. 9, description is made of an example of acknowledgment control of the temperature sensor 5 including the thermistor TH from which the protective tape 51 has peeled off, according to a second embodiment of the present invention. FIG. 8 and FIG. 9 are flowcharts illustrating the example of the acknowledgment control for the temperature sensor 5 including the thermistor TH from which the protective tape 51 has peeled off, according to the second embodiment of the present invention. FIG. 8 and FIG. 9 are two separate diagrams of a series of control according to the second embodiment.

Note that in this embodiment, description is made of control for determining the temperature sensor 5 including the thermistor TH from which the protective tape 51 has peeled off by using the temperature sensor 5A, the temperature sensor 5B, and the non-contact temperature sensor 5C.

First, this embodiment is different from the first embodiment in that the non-contact temperature sensor 5C is used to perform the acknowledgment control for the temperature sensor 5 including the thermistor TH from which the protective tape 51 has peeled off. However, the structure of a printer of this embodiment may be the same as the structure of the printer 100 described in the first embodiment in terms of, for example, the number of placed temperature sensors 5, the placement position of each of the temperature sensors 5.

This description is also directed to an example of the acknowledgment control for the temperature sensor 5 including the thermistor TH from which the protective tape 51 has peeled off at the time of turning on the main power. Therefore, the flowchart illustrated in FIG. 8 begins at the time of turning on the main power to the printer 100. When the main switch 75 is turned on, the power supply unit 73 generates various kinds of voltages, which are supplied to the control unit 7 and the like. As a result, the warm-up operation is started (Step #31), the heater H is brought into an ON state (Step #32), and the heating roller 11 and the pressure roller 12 are caused to rotate (Step #33). Those steps are the same as the steps of the first embodiment (Steps #1 to #3).

Subsequently, the control unit 7 checks whether or not one of the temperature sensor 5A and the temperature sensor 5B that has sensed a temperature exhibiting a smaller difference from (closer to) the sensed temperature of the non-contact temperature sensor 5C may sense that the predetermined temperature has been reached (Step #34). In other words, the control unit 7 checks whether or not the temperature sensor 5 (5A or 5B) that has sensed a temperature closer to the sensed temperature of the non-contact temperature sensor 5C has sensed that the heating roller 11 has been heated to the predetermined temperature. Here, the predetermined temperature is the same as in the first embodiment in that the predetermined temperature represents a temperature lower than the fixing temperature (for example, 100° C. to 150° C.).

The control unit 7 performs judgment based on the temperature obtained by using the temperature sensor 5 that has sensed a temperature exhibiting a smaller difference from the sensed temperature of the non-contact temperature sensor 5C, and hence may accurately confirm that the heating roller 11 has been heated to the predetermined temperature. Note that the control unit 7 may check whether or not the heating roller 11 has been heated to the predetermined temperature by using only the non-contact temperature sensor 5C.

If the temperature sensor 5 cannot sense that the predetermined temperature has been reached ("No" in Step #34), the procedure returns to, for example, Step #32. On the other hand, if the temperature sensor 5 may sense that the predetermined temperature has been reached ("Yes" in Step #34), the control unit 7 checks whether or not the temperatures sensed by using the temperature sensors 5 at both the ends of the heating roller 11, that is, the temperature sensor 5A and the temperature sensor 5B, exhibit a difference of the predetermined value or larger (Step #35). In this respect, Step #35 is the same as Step #5 of the first embodiment, and hence description thereof is omitted.

If the temperatures sensed by using the temperature sensor 5A and the temperature sensor 5B and recognized by the control unit 7 do not exhibit the difference of the predetermined value or larger (if the difference is less than the predetermined value; "No" in Step #35), the control unit 7 heats the heating roller 11 to the fixing temperature (Step #36). After that, the warm-up operation at the time of turning on the main power is brought to an end. After that, for example, unless the control unit 7 shifts to the power-saving mode, the control unit 7 repeatedly turns on/off the heater H and shifts to control for maintaining the temperature of the heating roller 11 at the fixing temperature.

On the other hand, if the temperatures sensed by using the temperature sensor 5A and the temperature sensor 5B and recognized by the control unit 7 exhibit the difference of the predetermined value or larger ("Yes" in Step #35), the control unit 7 stores the temperature difference into, for example, the storage unit 72 (Step #37). That is, the control unit 7 stores the temperature difference when any one of the temperature sensors 5 has sensed that the heating roller 11 has been heated to the predetermined temperature since the heater H entered an ON state after turning on the main power that started power supply to the fixing device 1. Further, the control unit 7 brings the heater H into an ON state and further heats the heating roller 11 from the predetermined temperature to the fixing temperature (Step #38). Those Steps #35 to #38 are the same as Steps #5 to #8 of the first embodiment.

Further, the control unit 7 checks whether or not one of the temperature sensor 5A and the temperature sensor 5B that has sensed a temperature exhibiting a smaller difference from (closer to) the sensed temperature of the non-contact temperature sensor 5C may sense that the fixing temperature has been reached (Step #39). In other words, the control unit 7 checks whether or not the temperature sensor 5 (5A or 5B) that has sensed a temperature closer to the sensed temperature of the non-contact temperature sensor 5C has sensed that the heating roller 11 has been heated to the fixing temperature.

The control unit 7 checks whether or not the heating roller 11 has been heated to the fixing temperature based on the temperature obtained by using the temperature sensor 5 that has sensed a temperature exhibiting a smaller difference from the sensed temperature of the non-contact temperature sensor 5C, and hence may accurately confirm that the heating roller 11 has been heated to the fixing temperature. Note that the control unit 7 may check whether or not the heating roller 11 has been heated to the fixing temperature by using only the non-contact temperature sensor 5C.

If neither of the temperature sensor 5A and the temperature sensor 5B does not sense that the heating roller has been heated to the fixing temperature ("No" in Step #39), the procedure returns to, for example, Step #38. On the other hand, if any one of the temperature sensor 5A and the temperature sensor 5B senses that the fixing temperature has been reached (senses that the heating roller 11 has been almost heated to the fixing temperature) ("Yes" in Step #39), the control unit 7 checks whether or not both the temperature sensed by using the temperature sensor 5A and the temperature sensed by using the temperature sensor 5B have risen in comparison with a time when it was checked in Step #34 whether or not the predetermined temperature was reached (Step #40).

If both the temperatures sensed by the temperature sensor 5A and the temperature sensor 5B have risen ("Yes" in Step #40), the temperature sensor 5 including the thermistor TH from which the protective tape 51 has peeled off is determined (Step #41).

The control unit 7 determines, for example, one of the temperature sensor 5A and the temperature sensor 5B that exhibits a larger temperature difference from the temperature obtained by using the non-contact temperature sensor 5C as the temperature sensor 5 including the thermistor TH from which the protective tape 51 has peeled off. That is, the control unit 7 recognizes the temperature at a sensing part of the non-contact temperature sensor 5C based on the signal received from the non-contact temperature sensor 5C, and determines the temperature sensor 5 that exhibits the largest temperature difference from the recognized temperature sensed by using the non-contact temperature sensor 5C as the temperature sensor 5 in which the protective tape 51 has peeled off. Alternatively, in the same manner as in the first embodiment, the control unit 7 may determines that the protective tape 51 has peeled off from the thermistor TH of one of the temperature sensor 5A and the temperature sensor 5B that has sensed a higher temperature (Step #10 of the first embodiment).

On the other hand, if both the temperatures sensed by the temperature sensor 5A and the temperature sensor 5B have not risen ("No" in Step #40), the control unit 7 uses the liquid crystal display unit 61 and the indicators 62 of the operation panel 6 to issue the notification that the fixing device 1 has failed (Step #42). In this respect, Step #42 is the same as Step #12 of the first embodiment.

Note that the correction of the temperature sensed by using the temperature sensor 5 determined to include the thermistor TH from which the protective tape 51 has peeled off according to this embodiment may be performed in the same manner as in the first embodiment. In other words, in the same manner as in the first embodiment described with reference to FIG. 7, the control unit 7 may use the temperature sensed by the temperature sensor 5 determined to include the thermistor TH from which the protective tape 51 has peeled off according to this embodiment after the correction thereof.

As described above with reference to the first embodiment and the second embodiment, if the difference between the recognized temperatures sensed respectively by using the respective temperature sensors 5 (temperature sensor units) is equal to or larger than the predetermined value, the heater H is temporarily brought into an ON state, and the rise in the temperature is checked. Accordingly, it may be checked whether or not there is an abnormality such as a wire break in the signal line between the control unit 7 and the temperature sensor 5 or the thermistor TH (temperature sensing element). Further, if the rise in the temperature is confirmed in all the contact temperature sensors 5 (temperature sensors 5A and 5B), the temperature difference is judged to have been caused not by the abnormality such as a wire break but by the peeling off of the protective tape 51 (protective member). In addition, the control unit 7 determines the temperature sensor 5 in which the protective tape 51 has peeled off, and corrects the recognized temperature sensed by using the determined temperature sensor 5.

The temperature sensed by the respective temperature sensors 5 may thus be set to an appropriate value even if the protective tape 51 has peeled off. Further, the correction eliminates erroneous sensing of a failure, an error, or the like regarding the one-sided sheet conveyance because of the fact that the temperatures sensed by using the respective temperature sensors 5 exhibit a difference of the fixed value or larger. Further, the user may use the fixing device 1 as it is. Accordingly, the replacement of the fixing device 1 only due to the peeling off of a protective tape is eliminated, which alleviates the load on the user in terms of cost. Further, an unusable state of the image forming apparatus for a checkup of the fixing device 1 due to the erroneous sensing of the failure does not last.

Further, while the temperature is sensed by the temperature sensor 5 with the state in which the protective tape 51 exists as a reference, the temperature sensor 5 in which the protective tape 51 has peeled off may exhibit a larger temperature difference from the temperature sensed by using the non-contact temperature sensor 5C. Hence, the temperature sensor 5 that exhibits a larger temperature difference from the recognized temperature sensed by the non-contact temperature sensor 5C is determined as the temperature sensor 5 in which the protective tape 51 has peeled off (in particular, in the second embodiment). Accordingly, the temperature sensor 5 in which the protective tape 51 has peeled off may be determined with accuracy. Further, the correction of the sensed temperature is also performed appropriately.

Further, if the protective tape 51 has peeled off, the thermistor TH from which the protective tape 51 has peeled off is brought into direct contact with the heating body, and the temperature of the thermistor TH from which the protective tape 51 has peeled off becomes closer and closer to the temperature of the heating roller 11 than the temperature of the thermistor TH from which the protective tape 51 has not peeled off. Therefore, the temperature sensed by using the thermistor TH from which the protective tape 51 has peeled off generally becomes high. Hence, it is determined that the protective tape 51 has peeled off in the temperature sensor 5 that has sensed the highest temperature (in particular, in the first embodiment). Accordingly, the temperature sensor 5 in which the protective tape 51 has peeled off may be determined with accuracy. Further, the correction of the sensed temperature is also performed appropriately.

Further, the difference between the respective temperatures sensed by the respective temperature sensors 5 is grasped and stored into the storage unit 72. Then, the correction of the temperature is performed by subtracting the stored temperature difference. Accordingly, in the case where the protective tape 51 has peeled off, that is, if the sensed temperature becomes high, by subtracting the temperature difference therefrom, the sensed temperature may be corrected to an appropriate temperature.

Further, for such reasons that the rate of change in the resistance value of a thermistor varies according to the temperature, immediately after the heater H is brought into an ON state after the main power is turned on, the respective sensed temperatures recognized by the control unit 7 do not exhibit a large difference in some cases. Hence, any one of the temperature sensors 5 is used to sense that the temperature has risen to the predetermined temperature, and the temperature difference is stored into the storage unit 72. Accordingly, it is possible to appropriately grasp the deviation in the sensed temperature, which is caused by the fact that the protective tape 51 has peeled off.

Further, if the temperature difference between the sensed temperatures is equal to or larger than the predetermined value, the heater H is temporarily brought into an ON state, and the rises in all the sensed temperature are checked. Accordingly, if it is determined that the difference between the respective sensed temperatures is not due to the peeling off of the protective tape 51 but due to another cause such as a wire break, it is judged that the fixing device 1 has failed.

Further, in the case where the sensed and recognized temperatures exhibit a difference of the fixed value or larger even after the correction is performed, it is assumed that the one-sided conveyance of the sheet is being performed. Hence, in the case where the temperatures exhibit the difference of the fixed value or larger even after the correction is performed, it may be judged that the one-sided conveyance of the sheet that may generate the excessive temperature rise at one portion of the heating body is being performed.

Further, the notification unit notifies the user of the occurrence of the failure, and hence the user may recognize that the fixing device 1 should not be used and that the printing should not be performed. Further, it is possible to provide the image forming apparatus which avoids the erroneous sensing of a failure or an error merely based on the peeling off of the protective tape 51. Further, it is possible to provide the image forming apparatus which avoids the replacement of the fixing device 1 due to the erroneous sensing of the failure occurrence merely for the reason that the protective tape 51 has peeled off and which facilitates maintenance, reduces running costs, and is useful for the user.

Next, description is made of another embodiment. The above-mentioned embodiments are described by taking the example of the roller-type fixing device 1 including the heating roller 11 and the pressure roller 12. However, for example, the present invention may be applied to the fixing device 1 in which a belt or a film is stretched across two rotators, with the pressure roller 12 in press contact with one of the rotators. In the fixing device 1 in this format, the belt or the film is heated, and the sheet having the toner image transferred thereonto enters the nip formed between the belt or the film and the pressure roller 12. Accordingly, the belt or the film serves as the heating body, and the temperature sensors 5 are arranged in order to sense the belt or the film.

Further, the present invention may be construed as a control method for the fixing device as illustrated in FIG. 5 to FIG. 9.

In the above, the embodiments of the present invention have been described. However, the scope of the present invention is not limited thereto, and the present invention may be implemented by being subjected to various modifications without departing from the gist of the present invention.

What is claimed is:

1. A fixing device, comprising:

a heater;

a heating body that is heated by heat generated by the heater and is caused to rotate;

a pressure body that is in contact with the heating body, forms a nip through which a sheet having a toner image transferred thereonto enters, and is caused to rotate;

a plurality of temperature sensor units each including a temperature sensing element that is covered with a protective member and is in contact with the heating body in order to sense a temperature of the heating body; and a control unit that is configured to:

recognize temperatures of the heating body at respective portions thereof based on signals received from the plurality of temperature sensor units;

judge that a failure has occurred if the temperatures are different from each other by a fixed value or larger;

bring the heater into an ON state if the recognized temperatures exhibit a temperature difference of a predetermined value or larger, and then judge that the protective member has peeled off if all the temperatures sensed by using the plurality of temperature sensor units are recognized to have risen; and correct the recognized temperature sensed by using one of the plurality of temperature sensor units that has been determined to have the protective member peeled off.

2. The fixing device according to claim 1, further comprising a non-contact temperature sensor unit that is used for sensing the temperature of the heating body in a non-contact manner, wherein the control unit recognizes a temperature of a sensing part of the non-contact temperature sensor unit based on a signal received from the non-contact temperature sensor unit, and determines one of the plurality of temperature sensor units that exhibits a largest temperature difference from the recognized temperature sensed by using the non-contact temperature sensor unit as the one of the plurality of temperature sensor units that has been determined to have the protective member peeled off.

3. The fixing device according to claim 1, wherein the control unit determines that the protective member has peeled off in one of the plurality of temperature sensor units that has sensed a highest temperature.

4. The fixing device according to claim 1, further comprising a storage unit that stores data, wherein if it is judged that the protective member has peeled off, the control unit causes the storage unit to store a temperature difference between a temperature sensed by using the one of the plurality of temperature sensor units that has been determined to have the protective member peeled off and a temperature sensed by using one of the plurality of temperature sensor units in which the protective member has not peeled off, and performs the correcting by subtracting the stored temperature difference from the temperature sensed by using the one of the plurality of temperature sensor units that has been determined to have the protective member peeled off.

5. The fixing device according to claim 4, wherein the control unit stores the temperature difference when any one of the plurality of temperature sensor units senses that the heating body has been heated to a predetermined temperature after the heater enters into the ON state through turning on of a main power that starts power supply to the fixing device.

6. The fixing device according to claim 1, wherein the control unit judges that the failure has occurred if there is one of the plurality of temperature sensor units that does not sense a rise in the temperature even after the heater is brought into the ON state in a case where the temperatures that have been sensed and recognized exhibit a difference equal to or larger than the predetermined value.

7. The fixing device according to claim 6, further comprising a notification unit that issues a notification of a state of the fixing device, wherein the notification unit issues the notification of failure occurrence if the control unit judges that the failure has occurred.

8. The fixing device according to claim 1, wherein:

the plurality of temperature sensor units are located at both end portions of the heating body in an axis direction; and the control unit judges that the fixing device has failed due to one-sided sheet feeding if the sensed temperatures are different from each other by the fixed value or larger even after the correcting is performed.

9. The fixing device according to claim 8, further comprising a notification unit that issues a notification of a state of the fixing device, wherein the notification unit issues the notification of failure occurrence if the control unit judges that the failure has occurred.

10. An image forming apparatus, comprising the fixing device according to claim 1.

11. A control method for a fixing device, the fixing device comprising:

a heater;

a heating body that is heated by heat generated by the heater and is caused to rotate;

a pressure body that is in contact with the heating body, forms a nip through which a sheet having a toner image transferred thereonto enters, and is caused to rotate;

a plurality of temperature sensor units each including a temperature sensing element that is covered with a protective member and is in contact with the heating body in order to sense a temperature of the heating body; and a control unit that recognizes temperatures of the heating body at respective portions thereof based on signals received from the plurality of temperature sensor units, the control method comprising:

judging, by the control unit, that a failure has occurred if the temperatures are different from each other by a fixed value or larger;

bringing, by the control unit, the heater into an ON state if the recognized temperatures exhibit a temperature difference of a predetermined value or larger, and then judging that the protective member has peeled off if all the temperatures sensed by using the plurality of temperature sensor units are recognized to have risen; and correcting, by the control unit, the recognized temperature sensed by using one of the plurality of temperature sensor units that has been determined to have the protective member peeled off.

12. The control method for a fixing device according to claim 11, wherein:

the fixing device comprises a non-contact temperature sensor unit that is used for sensing the temperature of the heating body in a non-contact manner; and the control method further comprises:

recognizing, by the control unit, a temperature of a sensing part of the non-contact temperature sensor unit based on a signal received from the non-contact temperature sensor unit; and determining one of the plurality of temperature sensor units that exhibits a largest temperature difference from the recognized temperature sensed by using the non-contact temperature sensor unit as the one of the plurality of temperature sensor units that has been determined to have the protective member peeled off.

13. The control method for a fixing device according to claim 11, wherein the control unit determines that the protective member has peeled off in one of the plurality of temperature sensor units that has sensed a highest temperature.

14. The control method for a fixing device according to claim 11, wherein:

the fixing device comprises a storage unit that stores data; and the control method further comprises:

if it is judged that the protective member has peeled off, causing, by the control unit, the storage unit to store a temperature difference between a temperature sensed by using the one of the plurality of temperature sensor units that has been determined to have the protective member peeled off and a temperature sensed by using one of the plurality of temperature sensor units in which the protective member has not peeled off;

and performing, by the control unit, the correcting by subtracting the stored temperature difference from the temperature sensed by using the one of the plurality of temperature sensor units that has been determined to have the protective member peeled off.

15. The control method for a fixing device according to claim 14, further causing, by the control unit, the storage unit to store the temperature difference when any one of the plurality of temperature sensor units senses that the heating body has been heated to a predetermined temperature after the heater enters into the ON state through turning on of a main power that starts power supply to the fixing device.

16. The control method for a fixing device according to claim 11, further comprising judging, by the control unit, that the failure occurrence if there is one of the plurality of temperature sensor units that does not sense a rise in the temperature even after the heater is brought into the ON state in a case where the temperatures that have been sensed and recognized exhibit a difference equal to or larger than the predetermined value.

17. The control method for a fixing device according to claim 16, wherein:

the fixing device comprises a notification unit that issues a notification of a state of the fixing device; and the control method further comprises issuing, by the notification unit, the notification of failure occurrence if the control unit judges that the failure has occurred.

18. The control method for a fixing device according to claim 11, wherein:

the plurality of temperature sensor units are located at both end portions of the heating body in an axis direction; and the control method further comprises judging, by the control unit, that the fixing device has failed due to one-sided sheet feeding if the sensed temperatures are different from each other by the fixed value or larger even after the correcting is performed.

19. The control method for a fixing device according to claim 18, wherein:

the fixing device comprises a notification unit that issues a notification of a state of the fixing device; and the control method further comprises issuing, by the notification unit, the notification of failure occurrence if the control unit judges that the failure has occurred.

* * * * *